US010113519B2

(12) United States Patent
Ito

(10) Patent No.: US 10,113,519 B2
(45) Date of Patent: Oct. 30, 2018

(54) INTAKE APPARATUS

(71) Applicant: AISIN SEIKI KABUSHIKI KAISHA, Kariya-shi, Aichi-ken (JP)

(72) Inventor: Atsushi Ito, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 15/671,904

(22) Filed: Aug. 8, 2017

(65) Prior Publication Data

US 2018/0045150 A1 Feb. 15, 2018

(30) Foreign Application Priority Data

Aug. 9, 2016 (JP) ..... 2016-156130

(51) Int. Cl.
*F02M 35/00* (2006.01)
*F02M 35/10* (2006.01)

(52) U.S. Cl.
CPC *F02M 35/10222* (2013.01); *F02M 35/10091* (2013.01)

(58) Field of Classification Search
CPC ..... F02M 35/10; F02M 35/10144; F02M 35/10091; F02M 35/10111; F02M 35/10072; F02M 35/10032; F02M 35/10222; F02M 35/112
USPC ..... 123/568.17
See application file for complete search history.

(56) References Cited

U.S. PATENT DOCUMENTS 6,085,712 A * 7/2000 Ma ..... F02B 17/00 123/184.42
7,305,958 B2 12/2007 Doko et al.
2004/0079348 A1* 4/2004 Mori ..... F02M 35/10085 123/568.17
2004/0159299 A1* 8/2004 Uchiyama ..... F02M 25/06 123/184.42
2006/0191505 A1 8/2006 Doko et al.
2011/0219750 A1* 9/2011 Sakurai ..... F01N 3/103 60/285

(Continued)

FOREIGN PATENT DOCUMENTS

JP S61-029958 Y2 9/1986
JP S61-029961 Y2 9/1986

(Continued)

*Primary Examiner* — Thomas Moulis
(74) *Attorney, Agent, or Firm* — Buchanan Ingersoll & Rooney PC

(57) ABSTRACT

An intake apparatus includes an intake apparatus body including a plurality of intake pipes and a distribution passage including a gas passage before branching which includes a first gas passage through which the external gas flows in a first gas flow direction and a second gas passage through which the external gas flows in a second gas flow direction, the second gas passage curving relative to the first gas passage at a downstream, and a gas passage after branching including a third gas passage branched in the first gas flow direction relative to the second gas passage and a fourth gas passage branched in an opposite direction from the first gas flow direction relative to the second gas passage, an angle formed between the second gas passage and the third gas passage is smaller than an angle formed between the second gas passage and the fourth gas passage.

15 Claims, 4 Drawing Sheets

(56) References Cited

U.S. PATENT DOCUMENTS

| | | | | |
|---|---|---|---|---|
| 2012/0090578 | A1* | 4/2012 | Nakawatase | F02M 35/10104 123/527 |
| 2013/0118433 | A1* | 5/2013 | Tochizawa | F02M 35/10026 123/184.21 |
| 2013/0306041 | A1* | 11/2013 | Koga | F02M 25/07 123/568.11 |
| 2014/0014056 | A1* | 1/2014 | Sato | F02M 35/10072 123/184.47 |
| 2014/0326226 | A1* | 11/2014 | Senda | F01M 13/0011 123/573 |
| 2015/0252755 | A1* | 9/2015 | Sato | F02B 27/0215 123/568.29 |
| 2016/0341108 | A1* | 11/2016 | Utsumi | F02B 31/08 |
| 2017/0241377 | A1* | 8/2017 | Ito | F02M 35/112 |
| 2017/0306895 | A1* | 10/2017 | Teramoto | F02M 26/19 |
| 2018/0119655 | A1* | 5/2018 | Ito | F02M 35/10222 |
| 2018/0149120 | A1* | 5/2018 | Ito | F02M 35/10091 |

FOREIGN PATENT DOCUMENTS

| | | | |
|---|---|---|---|
| JP | S62-024790 | Y2 | 6/1987 |
| JP | 2006-241992 | A | 9/2006 |
| JP | 2014-137048 | A | 7/2014 |

* cited by examiner

INTAKE APPARATUS

CROSS REFERENCE TO RELATED APPLICATIONS

This application is based on and claims priority under 35 U.S.C. § 119 to Japanese Patent Application 2016-156130, filed on Aug. 9, 2016, the entire content of which is incorporated herein by reference.

TECHNICAL FIELD

This disclosure generally relates to an intake apparatus.

BACKGROUND DISCUSSION

An intake apparatus including a distribution passage which distributes external gas to plural intake pipes is known. Such intake apparatus is disclosed in, for example, JP2014-137048A which is hereinafter referred to as Reference 1.

Reference 1 discloses a flow passage configuration for an internal combustion engine, the flow passage configuration including an exhaust gas recirculation (EGR) passage provided at an intake manifold which includes plural intake passages for respective cylinders of the internal combustion engine. In the flow passage configuration disclosed in Reference 1, the EGR passage (distribution passage) includes a tournament-type flow passage configuration. The EGR passage is connected to each of the intake passages so that EGR gas is distributable to each of the plural intake passages. The EGR passage in the tournament-type includes a first passage (first gas passage) which extends to one side in a horizontal direction (in a first horizontal direction) and includes a closed end at a tip end portion in the first horizontal direction and a communication bore (second gas passage) which extends in a vertical direction and is connected to the first passage at an upstream side relative to the closed end, i.e., at the other side in the horizontal direction (in a second horizontal direction). The EGR passage also includes a second passage and a third passage connected to a downstream end of the communication bore and branched to the second horizontal direction and the first horizontal direction, respectively, from the downstream end of the communication bore.

In the aforementioned flow passage configuration according to Reference 1, because of the closed end of the first passage, the volume of the EGR gas (external gas) directly flowing to the communication bore from the first passage decreases. Accordingly, the volume of the EGR gas flowing by inertia to the third passage (third gas passage) where the EGR gas flows in the same flow direction as the flow direction of the EGR gas at the first passage (i.e., in the first horizontal direction) decreases. As a result, the volume of the EGR gas flowing to the second passage (fourth gas passage) and the volume of the EGR gas flowing to the third passage may be restrained from being unequal or disproportionate from each other. In the flow passage configuration disclosed in Reference 1, the first passage and the communication bore extend orthogonal to each other while the communication bore and each of the second and third passages extend orthogonal to each other.

According to the flow passage configuration disclosed in Reference 1, because the first passage and the communication bore extend orthogonal to each other while the communication bore and each of the second and third passages extend orthogonal to each other, it may be considered that the EGR gas is still easy to flow to the third passage because of inertia of the EGR gas. Thus, it may be considered that the volume of the EGR gas flowing to the second passage is inhibited from effectively increasing according to the flow passage configuration in Reference 1. As a result, imbalance or disproportion between volumes of the EGR gas distributed to the third passage (third gas passage) and to the second passage (fourth gas passage) may not be effectively restrained.

A need thus exists for an intake apparatus which is not susceptible to the drawback mentioned above.

SUMMARY

According to an aspect of this disclosure, an intake apparatus includes an intake apparatus body including a plurality of intake pipes provided for respective cylinders of a multi-cylinder engine, and a distribution passage distributing an external gas to the plurality of intake pipes, the distribution passage including a gas passage before branching including a first gas passage through which the external gas flows in a first gas flow direction and a second gas passage through which the external gas flows in a second gas flow direction, the second gas passage curving relative to the first gas passage at a downstream of the first gas passage, and a gas passage after branching including a third gas passage branched in the first gas flow direction relative to the second gas passage and a fourth gas passage branched in an opposite direction from the first gas flow direction relative to the second gas passage, an angle formed between the second gas passage and the third gas passage is smaller than an angle formed between the second gas passage and the fourth gas passage.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment is explained with reference to the attached drawings.

A construction of an intake apparatus 100 according to an embodiment is explained with reference to FIGS. 1 and 2. In the following explanation, based on an in-line four-cylinder engine 110, cylinders provided thereat are arranged along an X-axis. A direction orthogonal to the X-axis within a horizontal plane is specified to be a direction of a Y-axis. An up-down direction in a state where the intake apparatus 100 is mounted to a vehicle is specified to be a direction of a Z-axis. The in-line four-cylinder engine 110 serves as an example of a multi-cylinder engine which includes plural cylinders.

Figure 1:
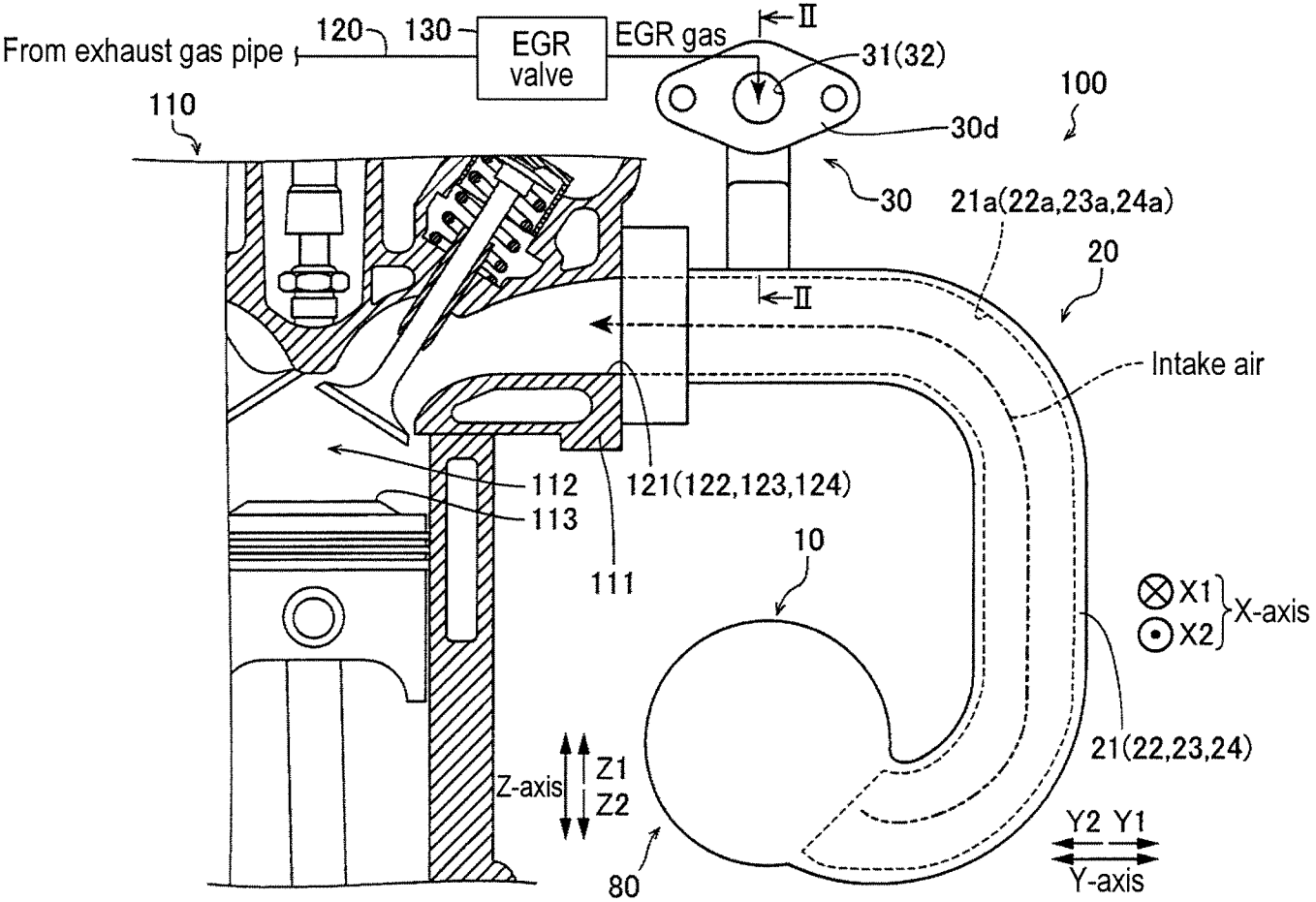
FIG. 1 is a side view of an intake apparatus according to an embodiment disclosed here when viewed along a line of cylinders of an in-line four-cylinder engine.

The intake apparatus 100 according to the present embodiment is mounted to the in-line four-cylinder engine 110 (which is hereinafter simply referred to as the engine 110) serving as a gasoline engine as illustrated in FIG. 1. The four cylinders of the engine 110 are arranged in line along the X-axis from a rear side towards a front side of a paper on which FIG. 1 is drawn. The intake apparatus 100 constitutes a part of an intake system which supplies air to the engine 110. The intake apparatus 100 includes an intake apparatus body 80 which includes a surge tank 10 and an intake pipe portion 20 arranged at a downstream of the surge tank 10.

The intake apparatus body 80 (i.e., the surge tank 10 and the intake pipe portion 20) is made of resin. The intake pipe portion 20 includes a function to distribute intake air which is stored at the surge tank 10 to each of the cylinders (i.e., a first cylinder, a second cylinder, a third cylinder and a fourth cylinder) within a corresponding cylinder head 111. An arrow Z2 direction in the intake pipe portion 20 corresponds to an intake upstream side (which is hereinafter simply referred to as an upstream side) where the intake pipe portion 20 is connected to the surge tank 10. An arrow Z1 direction in the intake pipe portion 20 corresponds to an intake downstream side (which is hereinafter simply referred to as a downstream side) where the intake pipe portion 20 is connected to the engine 110 (cylinder head 111).

The engine 110 is constructed so that exhaust gas recirculation (EGR) gas serving as a part of exhaust gas and discharged from a combustion chamber 112 (a cylinder 113) is recirculated via the intake apparatus 100. An EGR gas pipe 120 branched from an exhaust gas pipe of the engine 110 is connected to an EGR gas distribution portion 30 which is explained later. An EGR valve 130 which controls a recirculation volume of EGR gas (volume of EGR) is provided at a portion of the EGR gas pipe 120. The EGR gas contains water (water vapor). The EGR gas serves as an example of external gas.

The surge tank 10 is constructed to extend along the X-axis direction. The intake pipe portion 20 includes an intake pipe 21, an intake pipe 22, an intake pipe 23 and an intake pipe 24. As illustrated in FIG. 2, the intake pipes 21 to 24 are arranged along the X-axis direction and disposed in the mentioned order from an X1 direction to an X2 direction.

As illustrated in FIG. 1, first ends (Z2 direction) of the respective intake pipes 21 to 24 are connected to the surge tank 10. Second ends (Z1 direction) of the respective intake pipes 21 to 24 are connected to a first intake port 121 for the first cylinder provided at the most X1 side at the engine 110, to a second intake port 122 for the second cylinder, to a third intake port 123 for the third cylinder and to a fourth intake port 124 for the fourth cylinder provided at the most X2 side at the engine 110.

The intake apparatus 100 further includes the EGR gas distribution portion 30 serving as a distribution portion. The EGR gas distribution portion 30 is provided at the Z1 side relative to the intake pipe portion 20. The EGR gas distribution portion 30 includes a function to distribute the EGR gas which is recirculated to the engine 110 to the intake pipes 21 to 24 for the respective cylinders. The EGR gas distribution portion 30 is provided integrally with the intake apparatus body 80. That is, the EGR gas distribution portion 30 is made of resin in the same manner as the intake apparatus body 80. Accordingly, the intake apparatus body 80 to which the EGR gas distribution portion 30 is provided is light-weighted.

Figure 2:
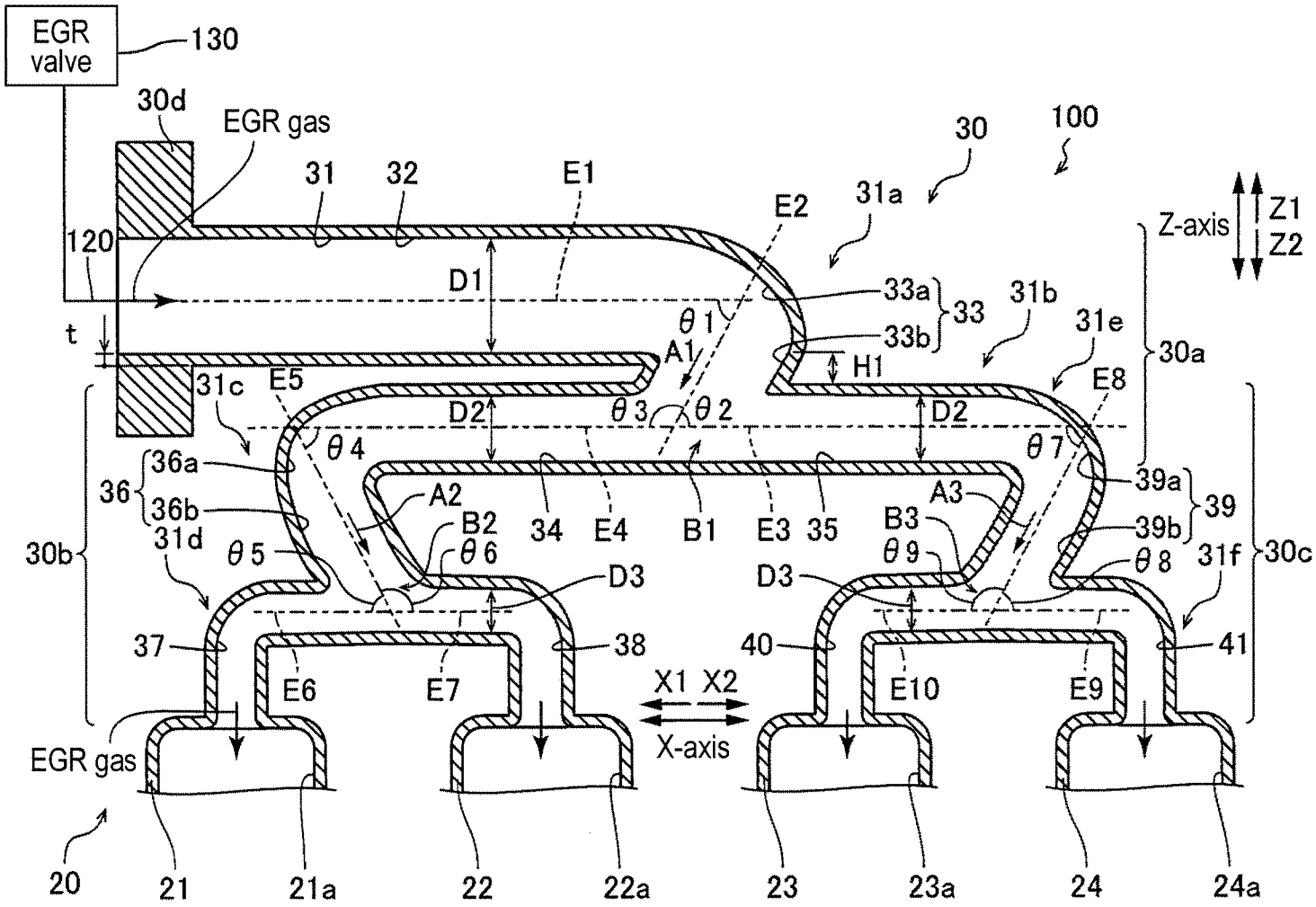
FIG. 2 is a schematic cross-sectional view taken along a line II-II in FIG. 1.

The EGR gas distribution portion 30 is a tubular member including a distribution passage 31 at an inside as illustrated in FIG. 2. The EGR gas distribution portion 30 is constructed so that the distribution passage 31 is branched in a two-step tournament style. That is, the EGR gas distribution portion 30 includes an EGR gas distribution portion 30*a* at the upstream side and a pair of EGR gas distribution portions 30*b* and 30*c* at the downstream side. The EGR gas distribution portion 30 is constructed so that each of gas passages before branching (which are hereinafter referred to as primary gas passages) 31*a*, 31*c* and 31*e* is branched to each of gas passages after branching (which are hereinafter referred to as secondary gas passages) 31*b*, 31*d* and 31*f* each of which is branched to two passages at each of the EGR gas distribution portions 30*a*, 30*b* and 30*c*. The thickness of the EGR gas distribution portion 30 at the distribution passage 31 is substantially constant and is a value t.

Specifically, the EGR gas distribution portion 30*a* at the upstream side includes gas passages 32, 33, 34 and 35. The gas passage 32 is connected to the EGR gas pipe 120 at the downstream side thereof (see FIG. 1). The gas passage 33 is connected to the gas passage 32 at the downstream side thereof. The gas passages 34 and 35 are connected to the gas passage 33 at a branch position B1 at the downstream side of the gas passage 33 so as to be branched from the gas passage 33 to the X1 side and the X2 side, respectively. The gas passages 32 and 33 constitute the primary gas passage 31*a* of the EGR gas distribution portion 30*a*. The gas passages 34 and 35 constitute the secondary gas passage 31*b* of the EGR gas distribution portion 30*a*. The gas passages 32 and 33 serve as examples of a first gas passage and a second gas passage, respectively.

The gas passage 32 is connected to the EGR gas pipe 120 at the X1 side and is provided extending in the X-axis direction (i.e., in a horizontal direction). Accordingly, at the gas passage 32, the EGR gas which flows from the EGR gas pipe 120 flows in the X2 direction. As compared to a case where the EGR gas flows from an upper side to a lower side to the gas passage 32, a length (height) of the EGR gas distribution portion 30 may be reduced, which may result in reduction in height of the intake apparatus 100. The X2 direction in the EGR gas distribution portion 30*a* at the upstream side serves as an example of a first gas flow direction. The EGR gas distribution portion 30 and the EGR gas pipe 120 are connected to each other by means of a flange portion 30*d* provided at the EGR gas distribution portion 30.

The gas passage 33 includes a curving portion 33*a* curving from the gas passage 32 and a straight portion 33*b* extending from the curving portion 33*a* to the branch position B1. The gas passage 33 curves from the gas passage 32 so that an intersection angle θ1 between an extension line E1 of the gas passage 32 and an extension line E2 of the straight portion 33*b* of the gas passage 33 forms an acute angle. The extension line E1 passes through a center of the gas passage 32. The extension line E2 is a straight line passing through a midpoint of the branch position B1 at which the three branched gas passages are obtained and extending along the gas passage 33 (specifically, the straight portion 33*b*) in the vicinity of the branch position B1. Accordingly, the straight portion 33*b* of the gas passage 33 extends in the Z2 direction (lower direction) while inclining in the X1 direction from the upstream side (where the gas passage 32 is provided) to the downstream side. As a result, in a case where a direction in which the straight portion 33*b* of the gas passage 33 extends (i.e., gas flow direction at the straight portion 33*b* of the gas passage 33) is specified to be an A1 direction, the A1 direction faces the X2 direction (i.e., gas flow direction at the gas passage 32) because an acute angle is formed therebetween. The angle θ1 is approximately 60 degrees, for example. The A1 direction serves as an example of a second gas flow direction.

The gas passage 34 is branched from the gas passage 33 (at the branch position B1) to the X1 side and is provided extending in the X-axis direction (horizontal direction). Accordingly, the EGR gas flowing from the gas passage 33 flows in the X1 direction at the gas passage 34. The gas passage 35 is branched from the gas passage 33 (at the branch position B1) to the X2 side and is provided extending in the X-axis direction (horizontal direction). Thus, the EGR gas flowing from the gas passage 33 flows in the X2 direction at the gas passage 35.

According to the present embodiment, an angle θ2 between the gas passage 33 and the gas passage 35 is specified to be smaller than an angle θ3 between the gas passage 33 and the gas passage 34. That is, the angle θ2 between the extension line E2 of the gas passage 33 and an extension line E3 of the gas passage 35 is specified to be smaller than the angle θ3 between the extension line E2 of the gas passage 33 and an extension line E4 (same as the extension line E3) of the gas passage 34. The extension line E3 passes through the midpoint of the branch position B1 and extends along the gas passage 35 in the vicinity of the branch position B1. The extension line E4 passes through the midpoint of the branch position B1 and extends along the gas passage 34 in the vicinity of the branch position B1. The angle θ2 and the angle θ3 are approximately 60 degrees and approximately 120 degrees, respectively, for example.

Because the angle θ3 between the gas passage 33 which curves relative to the gas passage 32 and the gas passage 34 is greater than the angle θ2 between the gas passage 33 and the gas passage 35, the EGR gas flowing through the gas passage 33 may easily flow to the gas passage 34. In addition, because of the gas passage 33 which curves from the gas passage 32 so that the intersection angle θ1 forms the acute angle, influence of inertia of the EGR gas flowing through the gas passage 32 in the X2 direction may be reduced. As a result, the EGR gas flowing in the X2 direction at the gas passage 32 is reduced to flow to the gas passage 35 where the EGR gas flows in the X2 direction in the same manner as the gas passage 32. Further, the EGR gas may easily flow to the gas passage 34 where the EGR gas flows in the X1 direction which is opposite from the flow direction of the EGR gas at the gas passage 32. As a result, the volume of the EGR gas distributed to the gas passage 34 and the volume of the EGR gas distributed to the gas passage 35 may be restrained from being unequal or disproportionate from each other.

In the entire gas passage 32, a cross-section of the gas passage 32 orthogonal to the X2 direction forms a circular shape including an inner diameter D1. In the same manner, in the entire gas passage 33, a cross-section of the gas passage 33 orthogonal to the A1 direction forms a circular shape including the inner diameter D1. That is, the primary gas passage 31*a* is constructed so that an area of the cross-section (cross-sectional area) of the gas passage 32 orthogonal to the X2 direction and an area of the cross-section (cross-sectional area) of the gas passage 33 orthogonal to the A1 direction are substantially constant.

In the entire gas passage 34, a cross-section of the gas passage 34 orthogonal to the X1 direction forms a circular shape including an inner diameter D2. In the entire gas passage 35, a cross-section of the gas passage 35 orthogonal to the X2 direction forms a circular shape including the inner diameter D2. That is, the secondary gas passage 31*b* is constructed so that an area of the cross-section (cross-sectional area) of the gas passage 34 orthogonal to the X1 direction (X-axis direction) and an area of the cross-section (cross-sectional area) of the gas passage 35 orthogonal to the X2 direction (X-axis direction) are substantially constant. The inner diameter D2 is smaller than the inner diameter D1. Accordingly, the pressure of the EGR gas at the primary gas passage 31*a* and the pressure of the EGR gas at the secondary gas passage 31*b* where approximately a half of the EGR gas flowing through the primary gas passage 31*a* flows are restrained from greatly differentiated from each other.

A length H1 of the straight portion 33*b* of the gas passage 33 in the Z-axis direction (up-down direction) is greater than a sum of the thickness t of the primary gas passage 31*a* (i.e., the gas passages 32 and 33) and the thickness t of the secondary gas passage 31*b* (i.e., the gas passages 34 and 35) (i.e., $H1>2\times t$).

Each of the EGR gas distribution portion 30*b* at the X1 side at the upstream side and the EGR gas distribution portion 30*c* at the X2 side at the downstream side includes the similar construction to the EGR gas distribution portion 30*a* at the upstream side.

Specifically, the EGR gas distribution portion 30*b* at the X1 side includes the gas passage 34 and gas passages 36, 37 and 38. The gas passage 34 is shared and commonly used with the EGR gas distribution portion 30*a* at the upstream side. The gas passage 36 is connected to the gas passage 34 at the downstream side thereof. The gas passages 37 and 38 are connected to the gas passage 36 at a branch position B2 at the downstream side of the gas passage 36 so as to be branched from the gas passage 36 to the X1 side and the X2 side, respectively. The gas passages 34 and 36 constitute the primary gas passage 31*c* of the EGR gas distribution portion 30*b*. The gas passages 37 and 38 constitute the secondary gas passage 31*d* of the EGR gas distribution portion 30*b*. The gas passage 34 serves as an example of a fourth gas passage at the EGR gas distribution portion 30*a* at the upstream side and as the first gas passage at the EGR gas distribution portion 30*b* at the downstream side. The gas passages 36, 37 and 38 serve as examples of the second gas passage, a third gas passage and the fourth gas passage, respectively.

The EGR gas at the gas passage 34 flows in the X1 direction as mentioned above. The X1 direction at the EGR gas distribution portion 30*b* at the downstream side serves as an example of the first gas flow direction.

The gas passage 36 includes a curving portion 36*a* which curves from the gas passage 34 and a straight portion 36*b* which extends from the curving portion 36*a*. The gas passage 36 curves from the gas passage 34 so that an intersection angle 84 between the extension line E4 of the gas passage 34 and an extension line E5 of the gas passage 36 forms an acute angle. The extension line E5 is a straight line passing through a midpoint of the branch position B2 at which the three branched gas passages are obtained and extending along the gas passage 36 (specifically, the straight portion 36*b*) in the vicinity of the branch position B2. As a result, the straight portion 36*b* of the gas passage 36 extends from the upstream side (where the gas passage 34 is provided) to the downstream side in the Z2 direction (lower direction) while inclining in the X2 direction. In a case where a direction in which the straight portion 36*b* of the gas passage 36 extends is specified to be an A2 direction, the A2 direction faces the X1 direction (i.e., gas flow direction at the gas passage 34) because an acute angle is formed therebetween. The angle 84 is approximately 60 degrees, for example. The A2 direction serves as an example of the second gas flow direction.

The gas passage 37 is branched from the gas passage 36 (at the branch position B2) to the X1 side and is provided extending in the X-axis direction (horizontal direction). Accordingly, the EGR gas flowing from the gas passage 36 flows in the X1 direction at the gas passage 37. The gas passage 37 is bent at substantially right angle so as to extend in the Z2 direction and is connected to an intake passage 21*a* within the intake pipe 21.

The gas passage 38 is branched from the gas passage 36 (at the branch position B2) to the X2 side and is provided extending in the X-axis direction (horizontal direction). Accordingly, the EGR gas flowing from the gas passage 36 flows in the X2 direction at the gas passage 38. The gas passage 38 is bent at substantially right angle so as to extend in the Z2 direction and is connected to an intake passage 22*a* within the intake pipe 22.

In the present embodiment, an angle θ5 between the gas passage 36 and the gas passage 37 is specified to be smaller than an angle θ6 between the gas passage 36 and the gas passage 38. That is, the intersection angle θ5 between the extension line E5 of the gas passage 36 and an extension line E6 of the gas passage 37 is specified to be smaller than the intersection angle θ6 between the extension line E5 of the gas passage 36 and an extension line E7 of the gas passage 38. The extension line E6 is a straight line passing through the midpoint of the branch position B2 and extending along the gas passage 37 in the vicinity of the branch position B2. The extension line E7 is a straight line passing through the midpoint of the branch position B2 and extending along the gas passage 38 in the vicinity of the branch position B2.

Accordingly, in the same way as the EGR gas distribution portion 30*a* at the upstream side, the EGR gas flowing in the X1 direction at the gas passage 34 is reduced to flow to the gas passage 37 where the EGR gas flows in the X1 direction in the same manner as the gas passage 34. In addition, the EGR gas may easily flow to the gas passage 38 where the EGR gas flows in the X2 direction which is opposite from the flow direction of the EGR gas at the gas passage 34. As a result, the volume of the EGR gas distributed to the gas passage 37 and the volume of the EGR gas distributed to the gas passage 38 are restrained from being unequal or disproportionate from each other.

In the same way as the EGR gas distribution portion 30*a* at the upstream side, a cross-sectional area of the primary gas passage 31*c* is substantially constant and a cross-sectional area of the secondary gas passage 31*d* is substantially constant. An inner diameter D3 of the secondary gas passage 31*d* is smaller than the inner diameter D2 of the primary gas passage 31*c*.

The EGR gas distribution portion 30*c* at the X2 side includes the gas passage 35 and gas passages 39, 40 and 41. The gas passage 35 is shared and commonly used with the EGR gas distribution portion 30*a* at the upstream side. The gas passage 39 is connected to the gas passage 35 at the downstream side thereof. The gas passages 40 and 41 are connected to the gas passage 39 at a branch position B3 at the downstream side of the gas passage 39 so as to be branched from the gas passage 39 to the X1 side and the X2 side, respectively. The gas passages 35 and 39 constitute the primary gas passage 31*e* of the EGR gas distribution portion 30*c*. The gas passages 40 and 41 constitute the secondary gas passage 31*f* of the EGR gas distribution portion 30*c*. The gas passage 35 serves as an example of the third gas passage at the EGR gas distribution portion 30*a* at the upstream side and serves as the first gas passage at the EGR gas distribution portion 30*c* at the downstream side. The gas passages 39, 40 and 41 serve as examples of the second gas passage, the fourth gas passage and the third gas passage, respectively.

The EGR gas flows in the X2 direction at the gas passage 35 as mentioned above. The X2 direction at the EGR gas distribution portion 30*c* at the downstream side serves as an example of the first gas flows direction.

The gas passage 39 includes a curving portion 39*a* curving from the gas passage 35 and a straight portion 39*b* extending from the curving portion 39*a*. The gas passage 39 curves from the gas passage 35 so that an intersection angle θ7 between the extension line E3 of the gas passage 35 and an extension line E8 of the gas passage 39 forms an acute angle. The extension line E8 is a straight line passing through a midpoint of the branch position B3 at which the three branched gas passages are obtained and extending along the gas passage 39 (specifically, the straight portion 39*b*) in the vicinity of the branch position B3. As a result, the straight portion 39*b* of the gas passage 39 extends from the upstream side (where the gas passage 35 is provided) to the downstream side in the Z2 direction (lower direction) while inclining in the X1 direction. In a case where a direction where the straight portion 39*b* of the gas passage 39 extends (i.e., gas flow direction at the gas passage 39) is specified to be an A3 direction, the A3 direction faces the X2 direction (gas flow direction at the gas passage 35) because an acute angle is formed therebetween. The angle θ7 is approximately 60 degrees, for example. The A3 direction is an example of the second gas flow direction.

The gas passage 40 is branched from the gas passage 39 (at the branch position B3) to the X1 side and is provided extending in the X-axis direction (horizontal direction). Thus, the EGR gas flowing from the gas passage 39 flows in the X1 direction at the gas passage 40. The gas passage 40 is bent at substantially right angle so as to extend in the Z2 direction and is connected to an intake passage 23*a* within the intake pipe 23.

The gas passage 41 is branched from the gas passage 39 (at the branch position B3) to the X2 side and is provided extending in the X-axis direction (horizontal direction). Thus, the EGR gas flowing from the gas passage 39 flows in the X2 direction at the gas passage 41. The gas passage 41 is bent at substantially right angle so as to extend in the Z2 direction and is connected to an intake passage 24*a* within the intake pipe 24.

In the present embodiment, an angle θ8 between the gas passage 39 and the gas passage 41 is specified to be smaller than an angle θ9 between the gas passage 39 and the gas passage 40. That is, the intersection angle θ8 between the extension line E8 of the gas passage 39 and an extension line E9 of the gas passage 41 is specified smaller than the intersection angle θ9 between the extension line E8 of the gas passage 39 and an extension line E10 of the gas passage 40. The extension line E9 is a straight line passing through the midpoint of the branch position B3 and extending along the gas passage 41 in the vicinity of the branch position B3. The extension line E10 is a straight line passing through the midpoint of the branch position B3 and extending along the gas passage 40 in the vicinity of the branch position B3.

In the same way as the EGR gas distribution portion 30*a* at the upstream side, the EGR gas flowing in the X2 direction at the gas passage 35 is reduced to flow to the gas passage 41 where the EGR gas flows in the X2 direction in the same manner as the gas passage 35. Further, the EGR gas may easily flow to the gas passage 40 where the EGR gas flows in the X1 direction opposite from the gas flow direction at the gas passage 35. As a result, the flow volume of the EGR gas distributed to the gas passage 40 and the flow volume of the EGR gas distributed to the gas passage 41 are restrained from being unequal or disproportionate from each other.

In the same way as the EGR gas distribution portion 30*a* at the upstream side, a cross-sectional area of the primary gas passage 31*e* is substantially constant and a cross-sectional area of the secondary gas passage 31*f* is substantially constant. The inner diameter D3 of the secondary gas passage 31*f* is smaller than the inner diameter D2 of the primary gas passage 31*e*.

As a result, in the EGR gas distribution portion 30, the EGR gas flowing through the gas passage 32 may be distributed to the gas passage 34 and the gas passage 35 in a less disproportionate manner. In addition, in the EGR gas distribution portion 30, the EGR gas flowing through the gas passage 34 may be distributed to the gas passage 37 and the gas passage 38 in a less disproportionate manner. Further, in the EGR gas distribution portion 30, the EGR gas flowing through the gas passage 35 may be distributed to the gas passage 40 and the gas passage 41 in a less disproportionate manner. Accordingly, in the EGR gas distribution portion 30 according to the present embodiment, the EGR gas supplied from the EGR gas pipe 120 is configured to be distributed to the intake passages 21*a* to 24*a* of the intake pipes 21 to 24 in a less disproportionate manner, i.e., substantially uniformly distributed to the intake passages 21*a* to 24*a* of the intake pipes 21 to 24.

According to the present embodiment, the following effects are obtainable. The effects below apply not only to the EGR gas distribution portion 30*a* at the upstream side but also to the EGR gas distribution portions 30*b* and 30*c* at the downstream side.

In the present embodiment, the angle θ2 between the gas passage 33 and the gas passage 35 branched from the gas passage 33 in the X2 direction is specified to be smaller than the angle θ3 between the gas passage 33 and the gas passage 34 branched from the gas passage 33 in the X1 direction. Accordingly, the angle formed by the gas passage 35 relative to the gas passage 33, i.e., the angle θ2, decreases so that the EGR gas is relatively difficult to flow to the gas passage 35 branched from the gas passage 33 to the X2 side while the angle formed by the gas passage 34 relative to the gas passage 33, i.e., the angle θ3, increases so that the EGR gas is relatively easy to flow to the gas passage 34 branched from the gas passage 33 to the X1 side opposite from the X2 side. As a result, the EGR gas may effectively flow and be distributed to the gas passage 34 where the EGR gas flowing through the gas passage 32 is relatively difficult to flow because of the gas passage 34 branching to the X1 side. Accordingly, because influence of inertia of the EGR gas is effectively reduced, the volume of the EGR gas distributed to the gas passage 34 and the volume of the EGR gas distributed to the gas passage 35 may be effectively restrained from being unequal or disproportionate from each other.

In the present embodiment, the gas passage 33 is curved or bent relative to the gas passage 32 so that the intersection angle θ1 between the extension line E1 of the gas passage 32 and the extension line E2 of the gas passage 33 forms the acute angle. Accordingly, being different from a case where the intersection angle θ1 between the extension line E1 of the gas passage 32 and the extension line E2 of the gas passage 33 is a right angle or an obtuse angle, for example, the A1 direction at the gas passage 33 may be brought to face the X2 direction at the gas passage 32. As a result, the EGR gas may be difficult to flow to the gas passage 35 branched in the X2 direction which faces the A1 direction while the EGR gas may effectively flow to the gas passage 34 branched in the X1 direction which does not face the A1 direction.

In the present embodiment, the cross-sectional area of the cross-section orthogonal to the X2 direction at the gas passage 32 and the cross-sectional area of the cross-section orthogonal to the A1 direction at the gas passage 33 are substantially constant. Accordingly, being different from a case where the cross-sectional area of the cross-section orthogonal to the X2 direction at the gas passage 32 and the cross-sectional area of the cross-section orthogonal to the A1 direction at the gas passage 33 are not constant, fluctuation of pressure of the EGR gas caused by variation in cross-sectional area at the distribution passage 31 is restrained at the gas passage 32 or the gas passage 33. As a result, water contained in the EGR gas is restrained from being liquefied at a portion where the pressure is low, for example.

In addition, in the present embodiment, the primary gas passage 31*a* (gas passages 32 and 33) and the secondary gas passage 31*b* (gas passages 34 and 35) are provided extending in the horizontal direction or extending while inclining downward from the upstream to the downstream in a state being mounted to the vehicle. Thus, even in a case where the water contained in the EGR gas is liquefied to generate water (condensed water), the condensed water is restrained from being stored within the primary gas passage 31*a* and the secondary gas passage 31*b*. Further, deposit constituted by condensed water and exhaust gas component is restrained from being deposited within the primary gas passage 31*a* and the secondary gas passage 31*b*. As a result, freezing of condensed water which interrupts flowing of the EGR gas through the gas passages 32 to 35 is restrained. In addition, adverse effect on combustion at the engine 110 caused by suction of a large amount of condensed water retained at the passages 32 to 35 into the intake pipes 21-24 at one time may be restrained.

Further, in the present embodiment, the length H1 of the gas passage 33 in the Z-axis direction is greater than the sum of the thickness t of the gas passage 32 in the Z-axis direction of the EGR gas distribution portion 30 and the thickness t of the gas passage 34 in the Z-axis direction of the EGR gas distribution portion 30 (i.e., $H1>2\times t$). Thus, the length H1 of the gas passage 33 in the Z-axis direction may be sufficiently secured, which may sufficiently secure the length of the gas passage 33 in the A1 direction. As a result, flow of the EGR gas through the gas passage 33 may be sufficiently adjusted or controlled.

Furthermore, in the present embodiment, the EGR gas distribution portion 30 is integrally provided with the intake apparatus body 80. Thus, positioning and assembly of the EGR gas distribution portion 30 relative to the intake apparatus body 80 are not necessary, which may simplify a manufacturing process. In addition, the EGR gas distribution portion 30 and the intake apparatus body 80 are integrally provided by resin, which may lead to reduction of weight of the intake apparatus 100.

Figure 3:
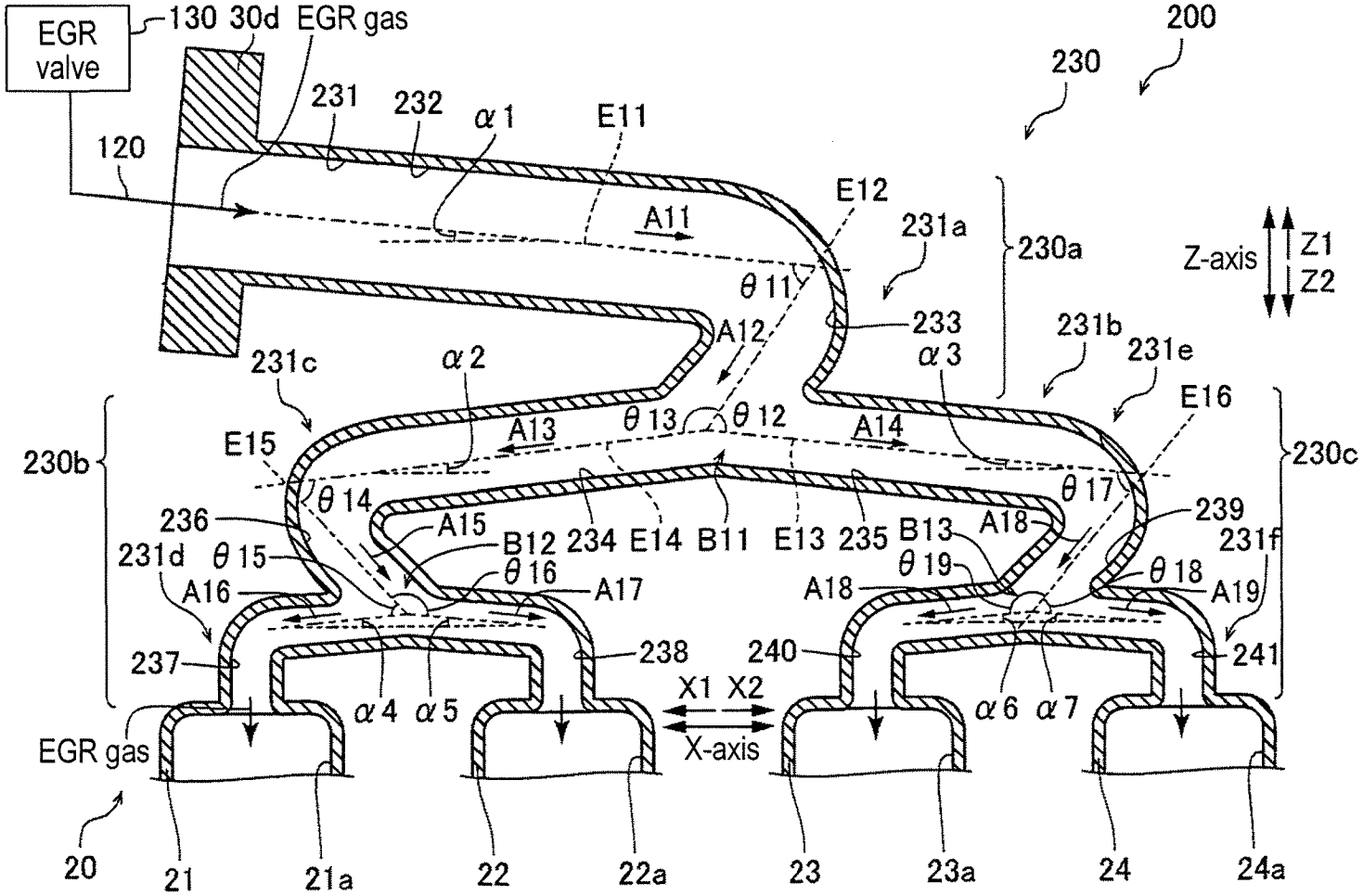
FIG. 3 is a schematic cross-sectional view of an intake apparatus according to a first modified example of the embodiment.

Next, a first modified example of the embodiment is explained with reference to FIG. 3. In the first modified example, being different from the aforementioned embodiment, all gas passages 232 to 241 are inclined downward (in the Z2 direction) from the upstream to the downstream, for example. In FIG. 3, similar constructions to those of the aforementioned embodiment bear the same reference numerals.

As illustrated in FIG. 3, an intake apparatus 200 according to the first modified example includes an EGR gas distribution portion 230 in place of the EGR gas distribution portion 30 of the aforementioned embodiment. The EGR gas distribution portion 230 is a tubular member including a distribution passage 231 at an inside. The EGR gas distribution portion 230 includes an EGR gas distribution portion 230*a* at the upstream side and a pair of EGR gas distribution portions 230*b* and 230*c* at the downstream side. The EGR gas distribution portion 230 is constructed so that each of gas passages before branching (which are hereinafter referred to as primary gas passages) 231*a*, 231*c* and 231*e* is branched to each of gas passages after branching (which are hereinafter referred to as secondary gas passages) 231*b*, 231*d* and 231*f* each of which is branched to two passages at each of the EGR gas distribution portions 230*a*, 230*b* and 230*c*.

Specifically, the EGR gas distribution portion 230*a* at the upstream side includes the gas passages 232, 233, 234 and 235. The gas passages 232 and 233 constitute the primary gas passage 231*a* of the EGR gas distribution portion 230*a*. The gas passages 234 and 235 constitute the secondary gas passage 231*b* of the EGR gas distribution portion 230*a*. The gas passages 232 and 233 serve as examples of the first gas passage and the second gas passage, respectively.

The gas passage 232 includes a different construction from the gas passage 32 according to the aforementioned embodiment. Specifically, the gas passage 232 extends in the X2 direction from the EGR gas pipe 120 (at the upstream side) towards the downstream side while inclining in the Z2 direction (lower direction). At this time, an angle $\alpha$1 of the gas passage 232 relative to the horizontal direction (i.e., in the X-axis direction) is approximately in a range from 5 degrees to 10 degrees, 5 degrees and 10 degrees being inclusive. Accordingly, the EGR gas flowing from the EGR valve 130 flows in the inclined direction (i.e., in an A11 direction) at the gas passage 232. The A11 direction serves as an example of the first gas flow direction.

The gas passage 233 curves from the gas passage 232 so that an intersection angle $\theta$11 between an extension line E11 of the gas passage 232 and an extension line E12 of the gas passage 233 forms an acute angle. The gas passage 233 extends in the Z2 direction (lower direction) from the upstream side (where the gas passage 232 is provided) to the downstream side while inclining in the X1 direction. That is, an A12 direction in which the gas passage 233 extends (i.e., a direction where the extension line E12 extends) faces the A11 direction because an acute angle is formed therebetween. The angle $\theta$11 is approximately 60 degrees, for example. The A12 direction serves as an example of the second gas flow direction.

The gas passage 234 includes a different construction from the gas passage 34 according to the aforementioned embodiment. The gas passage 234 extends in the X1 direction from a branch position B11 (at the upstream side) towards the downstream side while inclining in the Z2 direction (lower direction). At this time, an angle $\alpha$2 of the gas passage 234 relative to the horizontal direction is approximately in a range from 5 degrees (inclusive) to 10 degrees (inclusive). Accordingly, the EGR gas flowing from the gas passage 233 flows in the inclined direction (i.e., in an A13 direction) at the gas passage 234. In the same manner, the gas passage 235 includes a different construction from the gas passage 35 according to the aforementioned embodiment. The gas passage 235 extends in the X2 direction from the branch position B11 (at the upstream side) towards the downstream side while inclining in the Z2 direction (lower direction). At this time, an angle $\alpha$3 of the gas passage 235 relative to the horizontal direction is approximately in a range from 5 degrees (inclusive) to 10 degrees (inclusive). Accordingly, the EGR gas flowing from the gas passage 233 flows in the inclined direction (i.e., in an A14 direction) at the gas passage 235.

In the first modified example of the embodiment, an angle $\theta$12 between the gas passage 233 and the gas passage 235 is specified to be smaller than an angle $\theta$13 between the gas passage 233 and the gas passage 234. The angle $\theta$12 and the angle $\theta$13 are approximately 40 degrees and 120 degrees, respectively, for example.

Each of the EGR gas distribution portion 230*b* in the X1 direction at the downstream side and the EGR gas distribution portion 230*c* in the X2 direction at the downstream side includes the similar construction to that of the EGR gas distribution portion 230*a* at the upstream side.

Specifically, the EGR gas distribution portion 230*b* in the X1 direction includes the gas passages 234 and 236 to 238. The gas passage 234 is shared and commonly used with the EGR gas distribution portion 230*a* at the upstream side. The gas passages 234 and 236 constitute the primary gas passage 231*c* of the EGR gas distribution portion 230*b*. The gas passages 237 and 238 constitute the secondary gas passage 231*d* of the EGR gas distribution portion 230*b*. The gas passage 234 serves as an example of the fourth gas passage at the EGR gas distribution portion 230*a* at the upstream side and as the first gas passage at the EGR gas distribution portion 230*b* at the downstream side. The gas passages 236, 237 and 238 serve as examples of the second gas passage, the third gas passage and the fourth gas passage, respectively.

The EGR gas at the gas passage 234 flows in the A13 direction as mentioned above. The A13 direction at the EGR gas distribution portion 230*b* at the downstream side serves as an example of the first gas flow direction.

The gas passage 236 curves from the gas passage 234 so that an intersection angle $\theta$14 between an extension line E14 of the gas passage 234 and an extension line E15 of the gas passage 236 forms an acute angle. The gas passage 236 extends in the Z2 direction (lower direction) while inclining in the X2 direction from the upstream side (where the gas passage 234 is provided) to the downstream side. That is, an A15 direction in which the gas passage 236 extends (i.e., in a direction where the extension line E15 extends) faces the A13 direction because an acute angle is formed therebetween. The angle $\theta$14 is approximately 60 degrees, for example. The A15 direction serves as an example of the second gas flow direction.

The gas passage 237 includes a different construction from the gas passage 37 according to the aforementioned embodiment. The gas passage 237 extends in the X1 direction towards the downstream side from a branch position B12 (at the upstream side) while inclining in the Z2 direction (lower direction). At this time, an angle $\alpha$4 of the gas passage 237 relative to the horizontal direction is approximately in a range from 5 degrees (inclusive) to 10 degrees (inclusive). Thus, at the gas passage 237, the EGR gas flowing from the gas passage 236 flows in the inclined direction (i.e., in an A16 direction) and thereafter flows downward. In the same manner, the gas passage 238 includes a different construction from the gas passage 38 according to the aforementioned embodiment. The gas passage 238 extends in the X2 direction towards the downstream side from the branch position B12 (at the upstream side) while inclining in the Z2 direction (lower direction). At this time, an angle $\alpha$5 of the gas passage 238 relative to the horizontal direction is approximately in a range from 5 degrees (inclusive) to 10 degrees (inclusive). Thus, at the gas passage 238, the EGR gas flowing from the gas passage 236 flows in the inclined direction (i.e., in an A17 direction) and thereafter flows downward.

In the first modified example, an angle θ15 between the gas passages 236 and 237 is specified to be smaller than an angle θ16 between the gas passages 236 and 238. The angle θ15 and the angle θ16 are approximately 40 degrees and 120 degrees, respectively, for example.

In the same manner, the EGR gas distribution portion 230*c* in the X2 direction includes the gas passages 235, 239 to 241. The gas passage 235 is shared and commonly used with the EGR gas distribution portion 230*a* at the upstream side. The gas passages 235 and 239 constitute the primary gas passage 231*e* of the EGR gas distribution portion 230*c*. The gas passages 240 and 241 constitute the secondary gas passage 231*f* of the EGR gas distribution portion 230*c*. The gas passage 235 serves as an example of the third gas passage at the EGR gas distribution portion 230*a* at the upstream side and as the first gas passage at the EGR gas distribution portion 230*c* at the downstream side. The gas passages 239, 240 and 241 serve as examples of the second gas passage, the fourth gas passage and the third gas passage, respectively.

The EGR gas at the gas passage 235 flows in the A14 direction as mentioned above. The A14 direction at the EGR gas distribution portion 230*c* at the downstream side serves as an example of the first gas flow direction.

The gas passage 239 curves from the gas passage 235 so that an intersection angle θ17 between an extension line E13 of the gas passage 235 and an extension line E16 of the gas passage 239 forms an acute angle. The gas passage 239 extends in the Z2 direction (lower direction) while inclining in the X1 direction from the upstream side (where the gas passage 235 is provided) to the downstream side. That is, an A18 direction in which the gas passage 239 extends (i.e., in a direction where the extension line E16 extends) faces the A14 direction because an acute angle is formed therebetween. The angle θ17 is approximately 60 degrees, for example. The A18 direction serves as an example of the second gas flow direction.

The gas passage 240 includes a different construction from the gas passage 40 according to the aforementioned embodiment. The gas passage 240 extends in the X1 direction towards the downstream side from a branch position B13 (at the upstream side) while inclining in the Z2 direction (lower direction). At this time, an angle α6 of the gas passage 240 relative to the horizontal direction is approximately in a range from 5 degrees (inclusive) to 10 degrees (inclusive). Accordingly, the EGR gas flowing from the gas passage 239 flows in the inclined direction (i.e., in the A18 direction) and thereafter flows downward at the gas passage 240. In the same manner, the gas passage 241 includes a different construction from the gas passage 41 according to the aforementioned embodiment. The gas passage 241 extends in the X2 direction towards the downstream side from the branch position B13 (at the upstream side) while inclining in the Z2 direction (lower direction). At this time, an angle α7 of the gas passage 241 relative to the horizontal direction is approximately in a range from 5 degrees (inclusive) to 10 degrees (inclusive). Accordingly, the EGR gas flowing from the gas passage 239 flows in the inclined direction (i.e., in an A19 direction) and thereafter flows downward at the gas passage 241.

In the first modified example, an angle θ18 between the gas passages 239 and 241 is specified to be smaller than an angle θ19 between the gas passages 239 and 240. The angle θ18 and the angle θ19 are approximately 40 degrees and 120 degrees, respectively.

As a result, in the first modified example, in the same manner as the aforementioned embodiment, the EGR gas supplied from the EGR gas pipe 120 may be distributed to the intake passages 21*a* to 24*a* of the intake pipes 21 to 24 in a less disproportionate manner. The other constructions of the first modified example are similar to those of the aforementioned embodiment.

According to the first modified example, the following effects are obtainable. The effects below apply not only to the EGR gas distribution portion 230*a* at the upstream side but also to the EGR gas distribution portions 230*b* and 230*c* at the downstream side.

In the first modified example, the gas passage 233 extends while inclining downward from the upstream to the downstream. In addition, the gas passages 232, 234 and 235 extend while inclining downward from the upstream to the downstream at the respective angles α1, α2 and α3 which are equal to or greater than approximately 5 degrees relative to the horizontal direction. Thus, even in a case where water contained in the EGR gas is liquefied to generate water (condensed water), the condensed water is securely restrained from being stored within the primary gas passage 231*a* or the secondary gas passage 231*b*. Further, deposit constituted by condensed water and exhaust gas component is restrained from being deposited within the primary gas passage 231*a* and the secondary gas passage 231*b*.

In addition, in the first modified example, the gas passages 232, 234 and 235 extend while inclining downward from the upstream to the downstream at the respective angles α1, α2 and α3 which are equal to or smaller than approximately 10 degrees relative to the horizontal direction. Accordingly, the length (height) of the EGR gas distribution portion 230 in the up-down direction is restrained, which may lead to reduction in height of the intake apparatus 200. The other effects of the first modified example are similar to those of the aforementioned embodiment.

Figure 4:
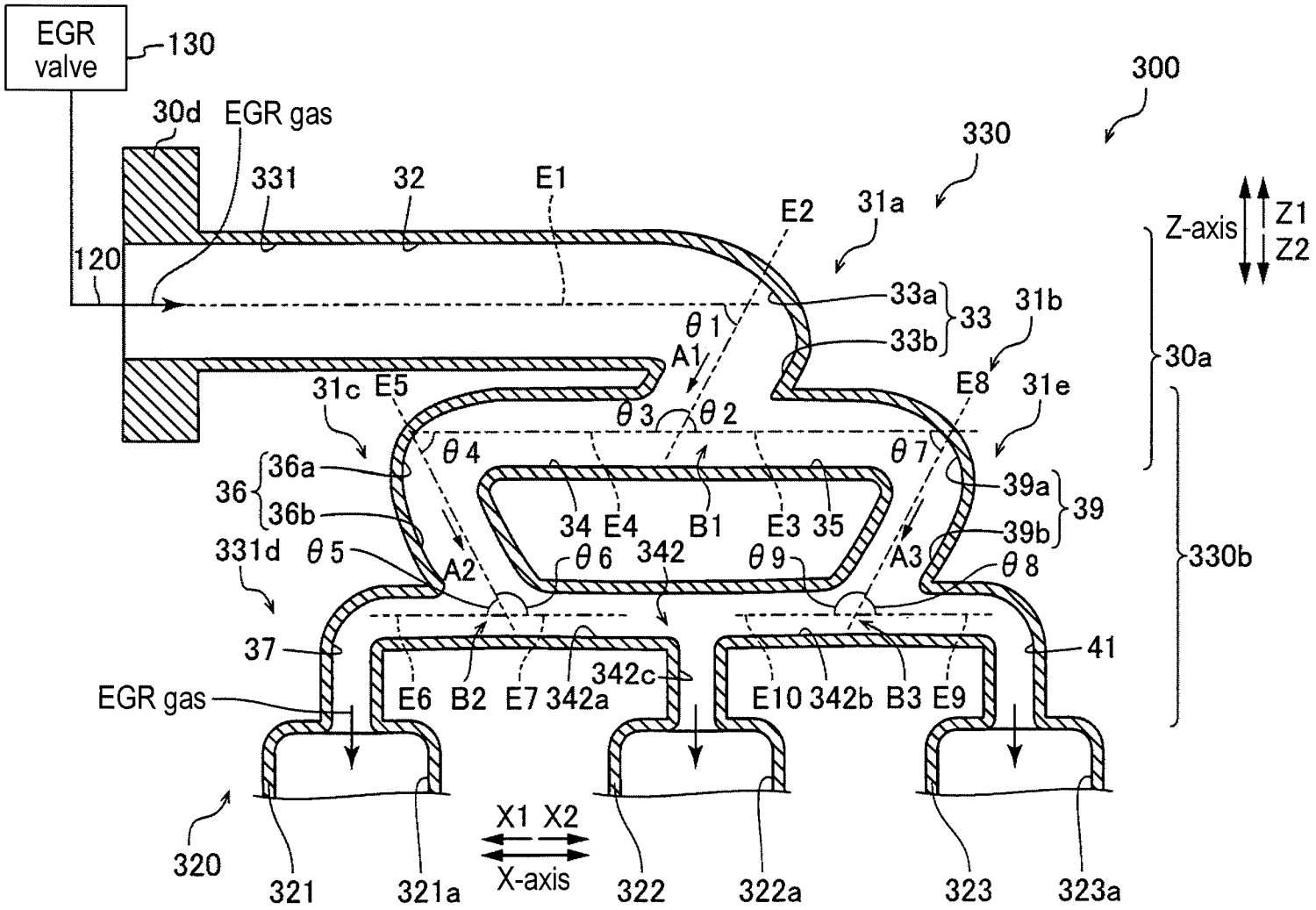
FIG. 4 is a schematic cross-sectional view of an intake apparatus according to a second modified example of the embodiment.

A second modified example of the embodiment is explained with reference to FIG. 4. In the second modified example, being different from the aforementioned embodiment, the EGR gas is distributed to three intake pipes 321, 322 and 323, for example. In FIG. 4, similar constructions to those of the aforementioned embodiment bear the same reference numerals.

An intake apparatus 300 according to the second modified example is mounted to an in-line three-cylinder engine. As illustrated in FIG. 4, the intake apparatus 300 includes an intake pipe portion 320 in place of the intake pipe portion 20 of the aforementioned embodiment. The intake pipes 321 to 323 are arranged along the X-axis direction and disposed in the mentioned order from the X1 side to the X2 side. The intake pipes 321 to 323 are constructed to supply intake air to the respective three cylinders of the engine.

The intake apparatus 300 includes an EGR gas distribution portion 330 in place of the EGR gas distribution portion 30 according to the aforementioned embodiment. The EGR gas distribution portion 330 is a tubular member including a distribution passage 331 at an inside. The EGR gas distribution portion 330 includes the EGR gas distribution portion 30*a* at the upstream side and an EGR gas distribution portion 330*b* at the downstream side. In the second modified example, the EGR gas distribution portion 330 is constructed so that, at the EGR gas distribution portion 330*b* at the downstream side, the two primary gas passages 31*c* and 31*e* are branched to a secondary gas passage 331*d* which is branched to three passages.

The EGR gas distribution portion 330*b* at the downstream side includes, in addition to the gas passages 34, 35, 36, 37, 39 and 41, a gas passage 342. The gas passage 342 is provided so that a portion of the gas passage 38 extending in the X direction and a portion of the gas passage 40 extending in the X direction according to the aforementioned embodiment are connected to each other at an intermediate portion in the X direction. That is, the gas passage 342 includes a gas passage 342*a* branched from the gas passage 36 (at the branch position B3) in the X2 direction and a gas passage 342*b* branched from the gas passage 39 (at the branch position B3) in the X1 direction, the gas passages 342*a* and 342*b* being connected to each other at the intermediate portion in the X direction. Each of the gas passages 342*a* and 342*b* is constructed to extend in the X-axis direction (horizontal direction). The gas passage 342 further includes a gas passage 342*c* which extends downward from a position at which the gas passage 342*a* and the gas passage 342*b* are connected to each other. Each of the gas passages 342*a* and 342*b* is an example of the fourth gas passage.

Accordingly, while the EGR gas flowing in the X1 direction at the gas passage 34 is relatively difficult to flow to the gas passage 37 where the EGR gas flows in the same X1 direction as the gas passage 34, the EGR gas is relatively easily flow to the gas passage 342*a* where the EGR gas flows in the X2 direction opposite from the gas flow direction at the gas passage 34. In the same manner, while the EGR gas flowing in the X2 direction at the gas passage 35 is relatively difficult to flow to the gas passage 41 where the EGR gas flows in the same X2 direction as the gas passage 35, the EGR gas is relatively easily flow to the gas passage 342*b* where the EGR gas flows in the X1 direction opposite from the gas flow direction at the gas passage 35. As a result, the respective volumes of the EGR gas distributed to the gas passages 37, 41 and 342 are restrained from being unequal or disproportionate from one another. The other constructions of the second modified example are similar to those of the aforementioned embodiment.

The aforementioned embodiment and modified examples thereof are examples and not limited to the aforementioned constructions. The aforementioned embodiment and modified examples thereof are appropriately modified or changed.

For example, in the aforementioned embodiment and modified examples thereof, the second gas passage (i.e., the gas passages 33, 36, 39, 233, 236 and 239) is curved so that the intersection angle between the extension line of the first gas passage (i.e., the gas passages 32, 34, 35, 232, 234 and 235) and the extension line of the second gas passage form the acute angle. Alternatively, as long as the second gas passage is curved, the intersection angle between the extension line of the first gas passage and the extension line of the second gas passage do not necessarily form the acute angle.

In the aforementioned embodiment, the first gas passage (gas passages 32, 34 and 35) and the secondary gas passage (i.e., the gas passages 34 and 35) are provided extending in the horizontal direction. In addition, in the first modified example, the first gas passage and the secondary gas passage extend while inclining downward from the upstream to the downstream relative to the horizontal direction. Alternatively, one of the first gas passage and the secondary gas passage may extend in the horizontal direction and the other of the first gas passage and the secondary gas passage may extend while inclining downward from the upstream to the downstream relative to the horizontal direction, for example. Further alternatively, a part of the first gas passage and the secondary gas passage may extend while inclining upward from the upstream to the downstream.

In the first modified example, the first gas passage and the secondary gas passage extend while inclining downward from the upstream to the downstream at the angle approximately in the range from 5 degrees (inclusive) to 10 degrees (inclusive) relative to the horizontal direction. Alternatively, at least one of the first gas passage and the secondary gas passage may extend while inclining downward from the upstream to the downstream at an angle smaller than approximately 5 degrees relative to the horizontal direction. Further alternatively, at least one of the first gas passage and the secondary gas passage may extend while inclining downward from the upstream to the downstream at an angle greater than approximately 10 degrees relative to the horizontal direction.

In the aforementioned embodiment and modified examples, the EGR gas is distributed as the external gas to the plural intake pipes 21 to 24 (321 to 323) via the distribution passage 31 (231, 331). Alternatively, gas other than the EGR gas may be distributed as the external gas to the plural intake pipes via the distribution passage. For example, blow-by gas leaking at a multi-cylinder engine may be distributed as the external gas to the plural intake pipes via the distribution passage. In this case, at the distribution passage, the cross-sectional area of the cross-section of the first gas passage orthogonal to the first gas flow direction and the cross-sectional area of the cross-section of the second gas passage orthogonal to the second gas flow direction are substantially constant so that the blow-by gas is effectively restrained from being liquefied within the distribution passage.

In the aforementioned embodiment and modified examples, the EGR gas distribution portion 30 (230, 330) is integrally provided with the intake apparatus body 80. Alternatively, the EGR gas distribution portion may be separately provided from the intake apparatus body 80.

In the aforementioned embodiment and modified examples, the distribution passage 31 (231, 331) is branched in the two-step tournament style. Alternatively, the distribution passage may be branched in one-step, three-step or more than three-step tournament style.

In the aforementioned embodiment and modified examples, the intake apparatus for each of the in-line four-cylinder engine 110 and the in-line three-cylinder engine serving as the gasoline engine is employed. Alternatively, the intake apparatus for an internal combustion engine including plural cylinders other than three and four may be employed.

In the aforementioned embodiment and modified examples, the intake apparatus for each of the in-line four-cylinder engine 110 and the in-line three-cylinder engine serving as the gasoline engine is employed. Alternatively, the intake apparatus for a diesel engine or a gas engine as the internal combustion engine, for example, may be employed.

In the aforementioned embodiment and modified examples, the intake apparatus for each of the in-line four-cylinder engine 110 and the three-cylinder engine for an automobile is employed. Alternatively, the intake apparatus for an internal combustion engine other than the automobile engine may be employed. The intake apparatus not only for the engine (internal combustion engine) mounted to a common vehicle (automobile) but also for an internal combustion engine for a transportation equipment such as a train, a ship and a vessel, for example, and an internal combustion engine mounted at a stationary equipment other than the transportation equipment may be employed.

According to the aforementioned embodiment and modified examples thereof, the angle θ2, θ5, θ8, θ12, θ15, θ18 formed between the second gas passage (gas passage 33, 36, 39, 233, 236, 239) and the third gas passage (gas passage 35, 37, 41, 235, 237, 241) which is branched in the first gas flow direction (X2, X1, A11, A13, A14 direction) relative to the second gas passage is smaller than the angle θ3, θ6, θ9, θ13, θ16, θ19 formed between the second gas passage and the fourth gas passage (gas passage 34, 38, 40, 234, 238, 240, 342*a*, 342*b*) which is branched in the opposite direction from the first gas flow direction relative to the second gas passage. Accordingly, while the external gas (EGR gas) is relatively difficult to flow to the third gas passage (gas passage 35, 37, 41, 235, 237, 241) branched in the first gas flow direction (X2, X1, A11, A13, A14 direction) by the decrease of the angle θ2, θ5, θ8, θ12, θ15, θ18 obtained by the third gas passage relative to the second gas passage (gas passage 33, 36, 39, 233, 236, 239), the external gas may relatively easily flow to the fourth gas passage (gas passage 34, 38, 40, 234, 238, 240, 342*a*, 342*b*) branched in the opposite direction from the first gas flow direction by the increase of the angle θ3, θ6, θ9, θ13, θ16, θ19 obtained by the fourth gas passage relative to the second gas passage. As a result, the external gas (EGR gas) may effectively flow to be distributed to the fourth gas passage (gas passage 34, 38, 40, 234, 238, 240, 342*a*, 342*b*) to which the external gas flowing through the first gas passage (gas passage 32, 34, 35, 232, 234, 235) is relatively difficult to be distributed because of the fourth gas passage branching in the opposite direction from the first gas flow direction (X2, X1, A11, A13, A14 direction). Because influence of inertia of the external gas (EGR gas) is effectively reduced, the volume of the external gas distributed to the fourth gas passage (gas passage 34, 38, 40, 234, 238, 240, 342*a*, 342*b*) and the volume of the external gas distributed to the third gas passage (gas passage 35, 37, 41, 235, 237, 241) branched from the second gas passage (gas passage 33, 36, 39, 233, 236, 239) which is connected to the first gas passage (gas passage 32, 34, 35, 232, 234, 235) may be effectively restrained from being unequal or disproportionate from each other.

According to the aforementioned embodiment and modified examples thereof, the second gas passage (gas passage 33, 36, 39, 233, 236, 239) is curved relative to the first gas passage (gas passage 32, 34, 35, 232, 234, 235) so that the intersection angle (θ1, θ4, θ7, θ11, θ14, θ17) between the extension line (E1, E4, E3, E11, E14, E13) of the first gas passage and the extension line (E2, E5, E8, E12, E15, E16) of the second gas passage forms the acute angle.

Accordingly, as being different from a case where the intersection angle (θ1, θ4, θ7, θ11, θ14, θ17) between the extension line (E1, E4, E3, E11, E14, E13) of the first gas passage (gas passage 32, 34, 35, 232, 234, 235) and the extension line (E2, E5, E8, E12, E15, E16) of the second gas passage (gas passage 33, 36, 39, 233, 236, 239) forms a right angle or an obtuse angle, for example, the second gas flow direction (A1, A2, A3, A12, A15, A18) at the second gas passage may face the first gas flow direction (X2, X1, A11, A13, A14 direction) at the first gas passage. As a result, while the external gas (EGR gas) is relatively difficult to flow to the third gas passage (gas passage 35, 37, 41, 235, 237, 241) branched in the direction facing the second gas flow direction (i.e., in the first gas flow direction), the external gas may effectively flow to the forth gas passage (gas passage 34, 38, 40, 234, 238, 240, 342*a*, 342*b*) branched in the direction not facing the second gas flow direction (i.e., in the opposite direction from the first gas flow direction).

According to the aforementioned embodiment and modified examples thereof, the cross-sectional area of the cross-section orthogonal to the first gas flow direction (X2, X1, A11, A13, A14 direction) at the first gas passage (gas passage 32, 34, 35, 232, 234, 235) and the cross-sectional area of the cross-section orthogonal to the second gas flow direction (A1, A2, A3, A12, A15, A18) at the second gas passage (gas passage 33, 36, 39, 233, 236, 239) are constant.

According to the aforementioned embodiment and modified examples thereof, being different from a case where the cross-sectional area of the cross-section orthogonal to the first gas flow direction (X2, X1, A11, A13, A14 direction) at the first gas passage (gas passage 32, 34, 35, 232, 234, 235) and the cross-sectional area of the cross-section orthogonal to the second gas flow direction (A1, A2, A3, A12, A15, A18) at the second gas passage (gas passage 33, 36, 39, 233, 236, 239) are inhibited from being constant, fluctuation of pressure of the external gas (EGR gas) caused by variation in cross-sectional area at the distribution passage (distribution passage 31) is restrained at the first gas passage or the second gas passage. As a result, in a case where water is contained in the external gas (EGR gas), for example, such water is restrained from being liquefied at a portion where the pressure is low.

According to the aforementioned embodiment and modified examples thereof, each of the gas passage before branching (gas passage 31*a*, 31*c*, 31*e*, 231*a*, 231*c*, 231*e*) and the gas passage after branching (gas passage 31*b*, 31*d*, 31*f*, 231*b*, 231*d*, 231*f*, 331*d*) extends in a horizontal direction or extends while inclining downward from the upstream to the downstream in a state where the intake apparatus (100, 200, 300) is mounted at a vehicle.

Accordingly, even in a case where the water contained in the external gas (EGR gas) is liquefied to generate water (condensed water), the condensed water is restrained from being stored within the gas passage before branching (gas passage 31*a*, 31*c*, 31*e*, 231*a*, 231*c*, 231*e*) and the gas passage after branching (gas passage 31*b*, 31*d*, 31*f*, 231*b*, 231*d*, 231*f*, 331*d*). As a result, freezing of condensed water which interrupts flowing of the external gas (EGR gas) through the gas passages is restrained. In addition, adverse effect on combustion at the internal combustion engine (engine 110) caused by suction of a large amount of condensed water retained at the gas passages into the intake pipes (intake pipes 21-24, 321-323) at one time may be restrained.

According to the aforementioned embodiment and modified examples thereof, the distribution passage (distribution passage 31) configures a tubular member, and a length of the second gas passage (gas passage 33) in the up-down direction in a state where the intake apparatus (100, 200, 300) is mounted at a vehicle is greater than a sum of the thickness t of the tubular member in the up-down direction at the first gas passage (gas passage 32) and the thickness t of the tubular member in the up-down direction at the fourth gas passage (gas passage 34).

Accordingly, the length H1 of the second gas passage (gas passage 33) in the up-down direction (Z-axis direction) may be sufficiently secured, which may sufficiently secure the length of the second gas passage in the second gas flow direction (A1 direction). As a result, flow of the external gas (EGR gas) through the second gas passage (gas passage 33) may be sufficiently adjusted or controlled.

According to the aforementioned embodiment and modified examples thereof, the intake apparatus body (intake apparatus body 80) and the distribution portion (EGR gas distribution portion 30) which constitutes the distribution passage (distribution passage 31) are integrally provided with each other.

Accordingly, the intake apparatus body (intake apparatus body 80) to which the distribution portion (EGR gas distribution portion 30) is provided is light-weighted.

According to the aforementioned embodiment and modified examples thereof, the external gas (EGR gas) includes at least one of exhaust gas which is recirculated and blow-by gas leaking at the multi-cylinder engine (engine 110).

According to the aforementioned embodiment and modified examples thereof, in a construction where each of the gas passage before branching (gas passage 31*a*, 31*c*, 31*e*, 231*a*, 231*c*, 231*e*) and the gas passage after branching (gas passage 31*b*, 31*d*, 31*f*, 231*b*, 231*d*, 231*f*, 331*d*) extends in the horizontal direction or extends while inclining downward from the upstream to the downstream, at least one of the first gas passage (gas passage 32, 34, 35, 232, 234, 235) of the gas passage before branching and the gas passage after branching extends while inclining at an angle in a range from 5 degrees to 10 degrees, 5 degrees and 10 degrees being inclusive, relative to the horizontal direction from the upstream to the downstream.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An intake apparatus comprising:

an intake apparatus body including a plurality of intake pipes provided for respective cylinders of a multi-cylinder engine; and a distribution passage distributing an external gas to the plurality of intake pipes, the distribution passage including:

a gas passage before branching including a first gas passage through which the external gas flows in a first gas flow direction and a second gas passage through which the external gas flows in a second gas flow direction, the second gas passage curving relative to the first gas passage at a downstream of the first gas passage; and a gas passage after branching including a third gas passage branched in the first gas flow direction relative to the second gas passage and a fourth gas passage branched in an opposite direction from the first gas flow direction relative to the second gas passage, an angle formed between the second gas passage and the third gas passage is smaller than an angle formed between the second gas passage and the fourth gas passage.

2. The intake apparatus according to claim 1, wherein the second gas passage is curved relative to the first gas passage so that an intersection angle between an extension line of the first gas passage and an extension line of the second gas passage forms an acute angle.

3. The intake apparatus according to claim 1, wherein a cross-sectional area of a cross-section orthogonal to the first gas flow direction at the first gas passage and a cross-sectional area of a cross-section orthogonal to the second gas flow direction at the second gas passage are constant.

4. The intake apparatus according to claim 2, wherein a cross-sectional area of a cross-section orthogonal to the first gas flow direction at the first gas passage and a cross-sectional area of a cross-section orthogonal to the second gas flow direction at the second gas passage are constant.

5. The intake apparatus according to claim 1, wherein each of the gas passage before branching and the gas passage after branching extends in a horizontal direction or extends while inclining downward from an upstream to a downstream in a state where the intake apparatus is mounted at a vehicle.

6. The intake apparatus according to claim 2, wherein each of the gas passage before branching and the gas passage after branching extends in a horizontal direction or extends while inclining downward from an upstream to a downstream in a state where the intake apparatus is mounted at a vehicle.

7. The intake apparatus according to claim 3, wherein each of the gas passage before branching and the gas passage after branching extends in a horizontal direction or extends while inclining downward from an upstream to a downstream in a state where the intake apparatus is mounted at a vehicle.

8. The intake apparatus according to claim 1, wherein the distribution passage configures a tubular member, a length of the second gas passage in an up-down direction in a state where the intake apparatus is mounted at a vehicle is greater than a sum of a thickness of the tubular member in the up-down direction at the first gas passage and a thickness of the tubular member in the up-down direction at the fourth gas passage.

9. The intake apparatus according to claim 2, wherein the distribution passage configures a tubular member, a length of the second gas passage in an up-down direction in a state where the intake apparatus is mounted at a vehicle is greater than a sum of a thickness of the tubular member in the up-down direction at the first gas passage and a thickness of the tubular member in the up-down direction at the fourth gas passage.

10. The intake apparatus according to claim 3, wherein the distribution passage configures a tubular member, a length of the second gas passage in an up-down direction in a state where the intake apparatus is mounted at a vehicle is greater than a sum of a thickness of the tubular member in the up-down direction at the first gas passage and a thickness of the tubular member in the up-down direction at the fourth gas passage.

11. The intake apparatus according to claim 4, wherein the distribution passage configures a tubular member, a length of the second gas passage in an up-down direction in a state where the intake apparatus is mounted at a vehicle is greater than a sum of a thickness of the tubular member in the up-down direction at the first gas passage and a thickness of the tubular member in the up-down direction at the fourth gas passage.

12. The intake apparatus according to claim 1, wherein the intake apparatus body and a distribution portion which constitutes the distribution passage are integrally provided with each other.

13. The intake apparatus according to claim 2, wherein the intake apparatus body and a distribution portion which constitutes the distribution passage are integrally provided with each other.

14. The intake apparatus according to claim 1, wherein the external gas includes at least one of exhaust gas which is recirculated and blow-by gas leaking at the multi-cylinder engine.

15. The intake apparatus according to claim 2, wherein the external gas includes at least one of exhaust gas which is recirculated and blow-by gas leaking at the multi-cylinder engine.

* * * * *